US007985107B2

(12) United States Patent
Li

(10) Patent No.: US 7,985,107 B2
(45) Date of Patent: Jul. 26, 2011

(54) BATTERY CONNECTOR AND PORTABLE ELECTRONIC DEVICE USING SAME

(75) Inventor: Jian-Hui Li, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 14 days.

(21) Appl. No.: 12/578,981

(22) Filed: Oct. 14, 2009

(65) Prior Publication Data

US 2010/0273336 A1 Oct. 28, 2010

(30) Foreign Application Priority Data

Apr. 27, 2009 (CN) ..... 2009 1 0301884

(51) Int. Cl.
*H01R 4/18* (2006.01)

(52) U.S. Cl. ..... 439/865; 439/885

(58) Field of Classification Search ..... 439/862, 439/326, 500, 83, 66, 70
See application file for complete search history.

(56) References Cited

U.S. PATENT DOCUMENTS

| | | | | |
|---|---|---|---|---|
| 4,266,845 | A * | 5/1981 | Ishikawa | 439/862 |
| 6,048,228 | A * | 4/2000 | Aso | 439/660 |
| 6,200,167 | B1 * | 3/2001 | Aso | 439/660 |
| 6,361,359 | B1 * | 3/2002 | Du et al. | 439/500 |
| 6,869,299 | B2 * | 3/2005 | Tanaka et al. | 439/188 |
| 6,951,488 | B2 * | 10/2005 | Hsieh | 439/660 |
| 6,994,576 | B2 * | 2/2006 | Tanaka et al. | 439/188 |
| 7,029,287 | B2 * | 4/2006 | Matsunaga et al. | 439/65 |
| 7,278,892 | B1 * | 10/2007 | Chien et al. | 439/862 |
| 7,300,320 | B2 * | 11/2007 | Lee | 439/862 |
| 7,357,665 | B1 * | 4/2008 | Yan | 439/500 |
| 7,803,011 | B1 * | 9/2010 | Mai | 439/500 |
| 7,806,739 | B2 * | 10/2010 | Hu et al. | 439/862 |
| 2007/0224890 | A1 * | 9/2007 | Chien et al. | 439/862 |
| 2008/0268712 | A1 * | 10/2008 | Wan et al. | 439/627 |
| 2009/0017369 | A1 * | 1/2009 | Shih | 429/121 |
| 2009/0023331 | A1 * | 1/2009 | Chien et al. | 439/500 |

* cited by examiner

*Primary Examiner* — T C Patel
*Assistant Examiner* — Harshad C Patel
(74) *Attorney, Agent, or Firm* — Steven M. Reiss

(57) ABSTRACT

A battery connecter includes a plurality of terminals. Each of the terminals includes a resisting portion, a supporting portion, and a contacting portion. The resisting portion includes a first portion and a second portion bent from the first portion. The supporting portion extends from the first portion and resists the second portion. The contacting portion is bent and extends from the supporting portion. The invention also discloses a portable electronic device using the battery connecter.

5 Claims, 5 Drawing Sheets

BATTERY CONNECTOR AND PORTABLE ELECTRONIC DEVICE USING SAME

BACKGROUND

1. Technical Field

The disclosure relates to battery connecters used in portable electronic devices.

2. Description of Related Art

Nowadays, portable electronic device such as mobile phones, laptops and personal digital assistants (PDAs) are widely used. The portable electronic device includes a battery providing power thereto. Thus, a battery connecter is necessary to be used in the portable electronic device for connecting the portable electronic device to the battery.

A typical battery connecter includes an insulative housing and a plurality of terminals respectively mounted in the insulative housing. The terminals partially extend from the insulative housing and connect the portable electronic device to the battery. However, each of the terminals is made by a metal strip bent and is respectively assembled in the insulative housing. Such structure of the terminals has poor strength and may easily be damaged.

Therefore, there is a room for improvement within the art.

BRIEF DESCRIPTION OF THE DRAWINGS

Many aspects of battery connecter and portable electronic device using the battery cover latch mechanism can be better understood with reference to the following drawings. The components in the drawings are not necessarily to scale, the emphasis instead being placed upon clearly illustrating the principles of the present battery connecter and the portable electronic device using the battery connecter. Moreover, in the drawings, like reference numerals designate corresponding parts throughout the several views.

DETAILED DESCRIPTION OF THE EMBODIMENTS

Figure 1:
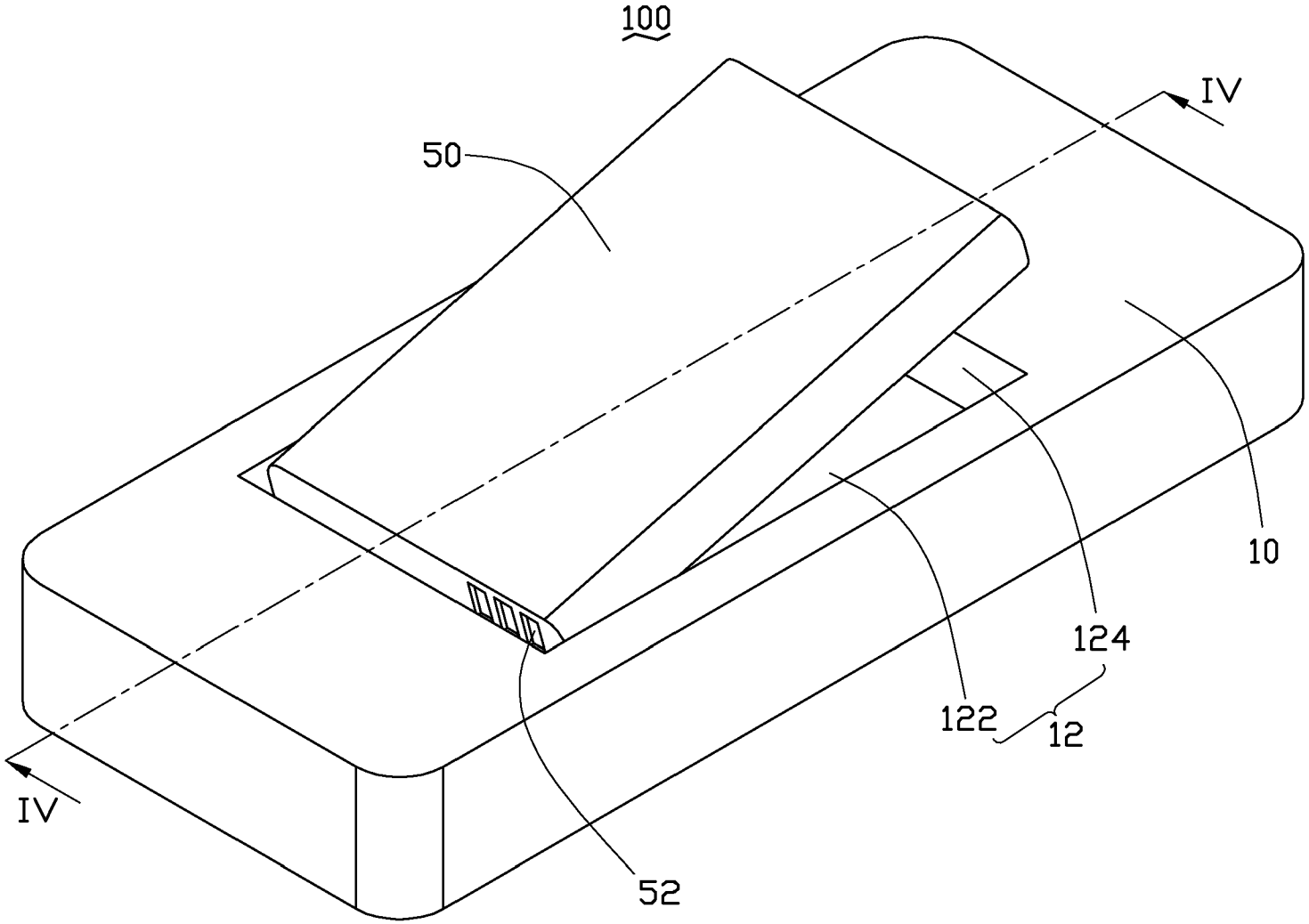
FIG. 1 is an isometric view of a battery partially assembled in a portable electronic device according to an exemplary embodiment.
Figure 2:
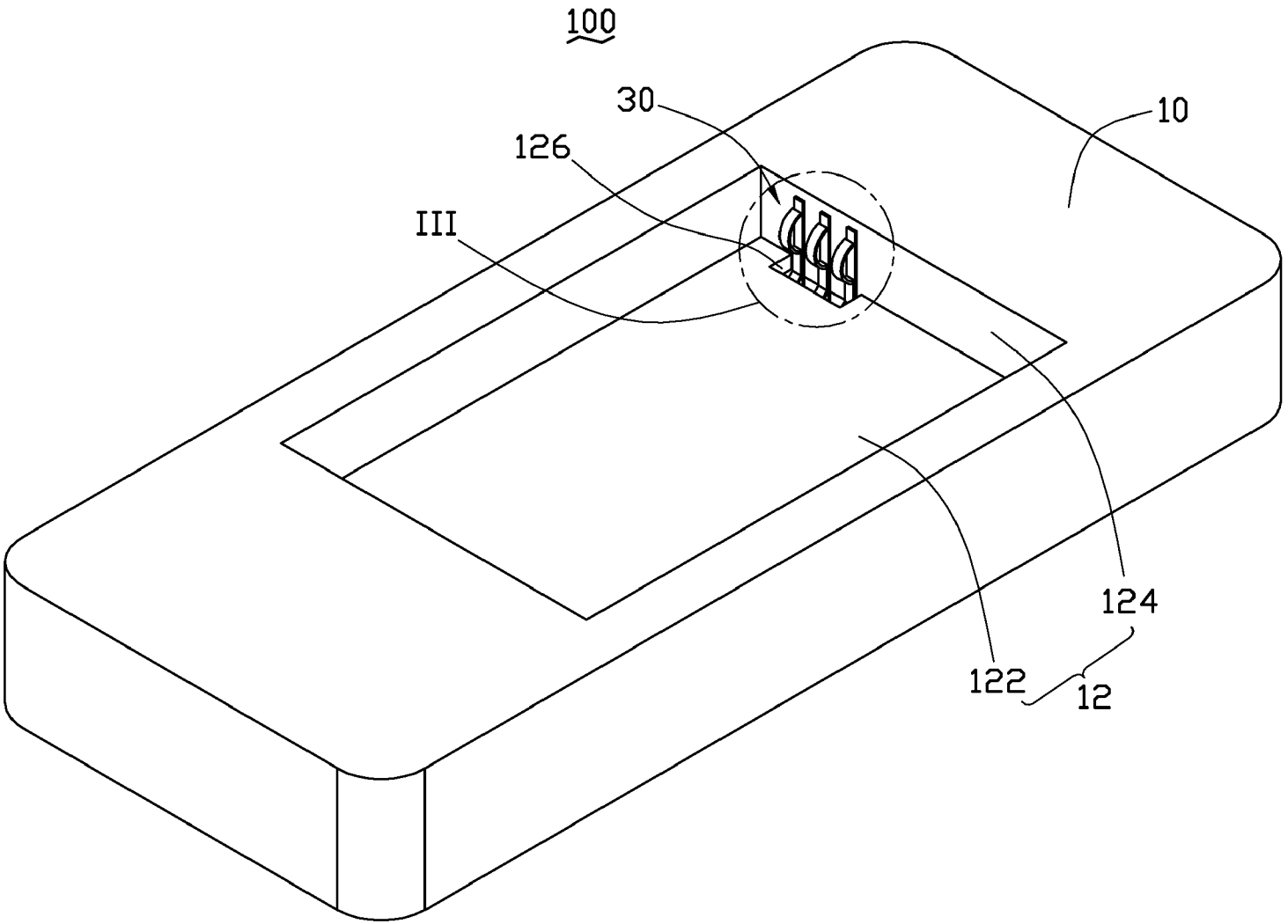
FIG. 2 is an isometric view of the portable electronic device shown in FIG. 1.

FIG. 1 and FIG. 2 show a portable electronic device 100 including a main body 10, a battery connecter 30 disposed on the main body 10, and a battery 50 assembled in the main body 10.

Figure 4:
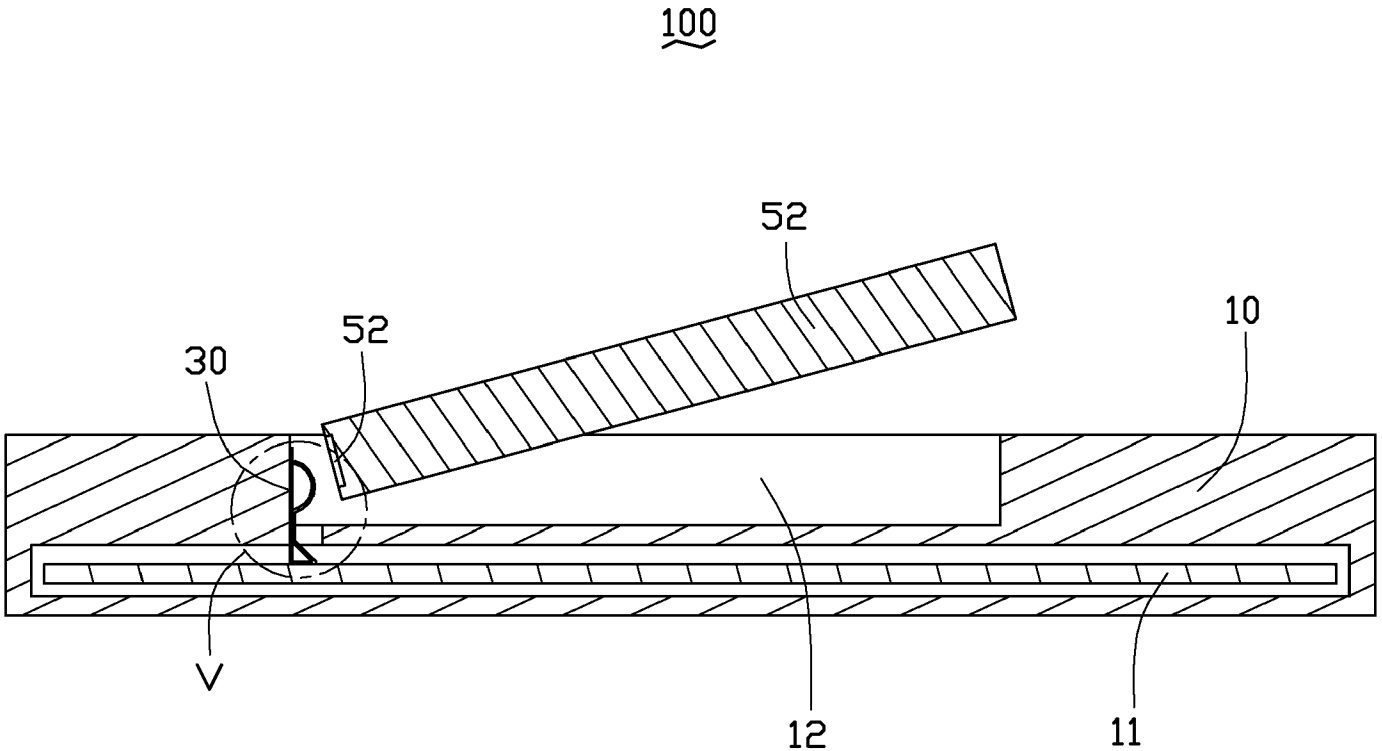
FIG. 4 is a cross sectional view of the portable electronic device taken along line IV-IV.

Referring to FIG. 4, the main body 10 includes a printed circuit board 11. The main body 10 defines a receiving chamber 12 for accommodating the battery 50. The receiving chamber 12 includes a bottom wall 122 and a peripheral wall 124 perpendicularly extending from the bottom wall 122. The bottom wall 122 defines an opening 126 adjacent to the peripheral wall 124. One portion of the printed circuit board 11 may be exposed by the opening 126.

Figure 3:
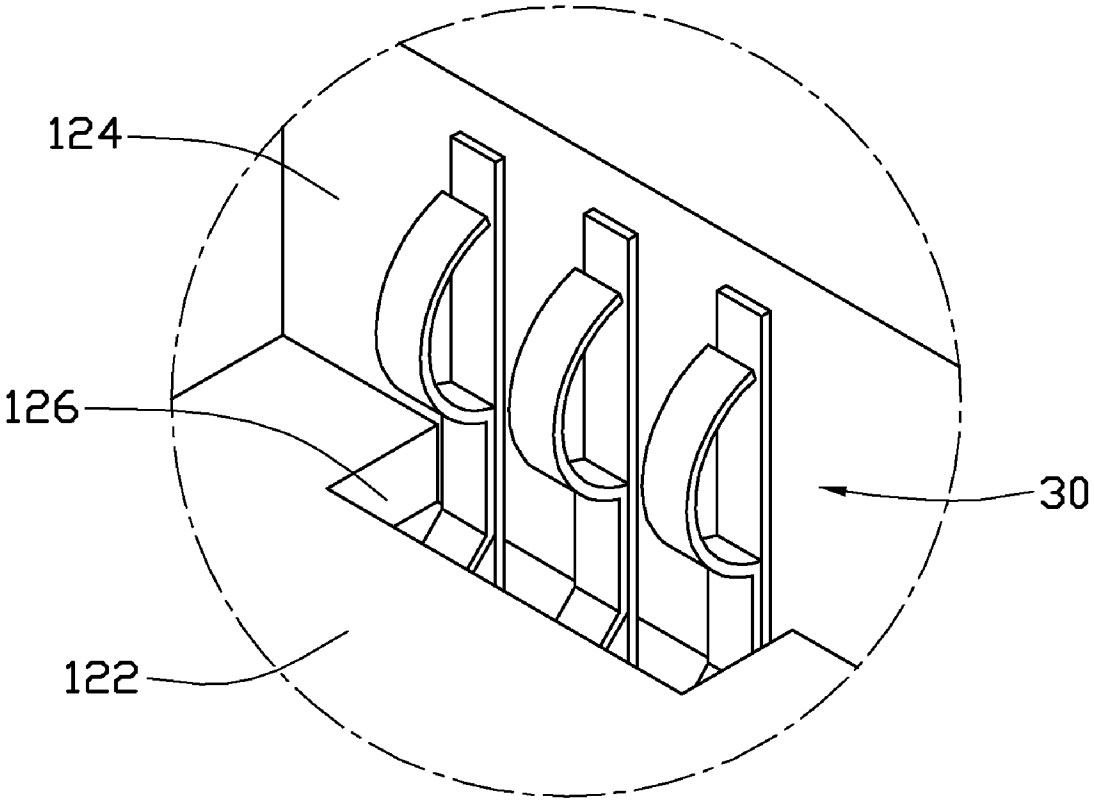
FIG. 3 is an enlarged view at III area shown in FIG. 2.
Figure 5:
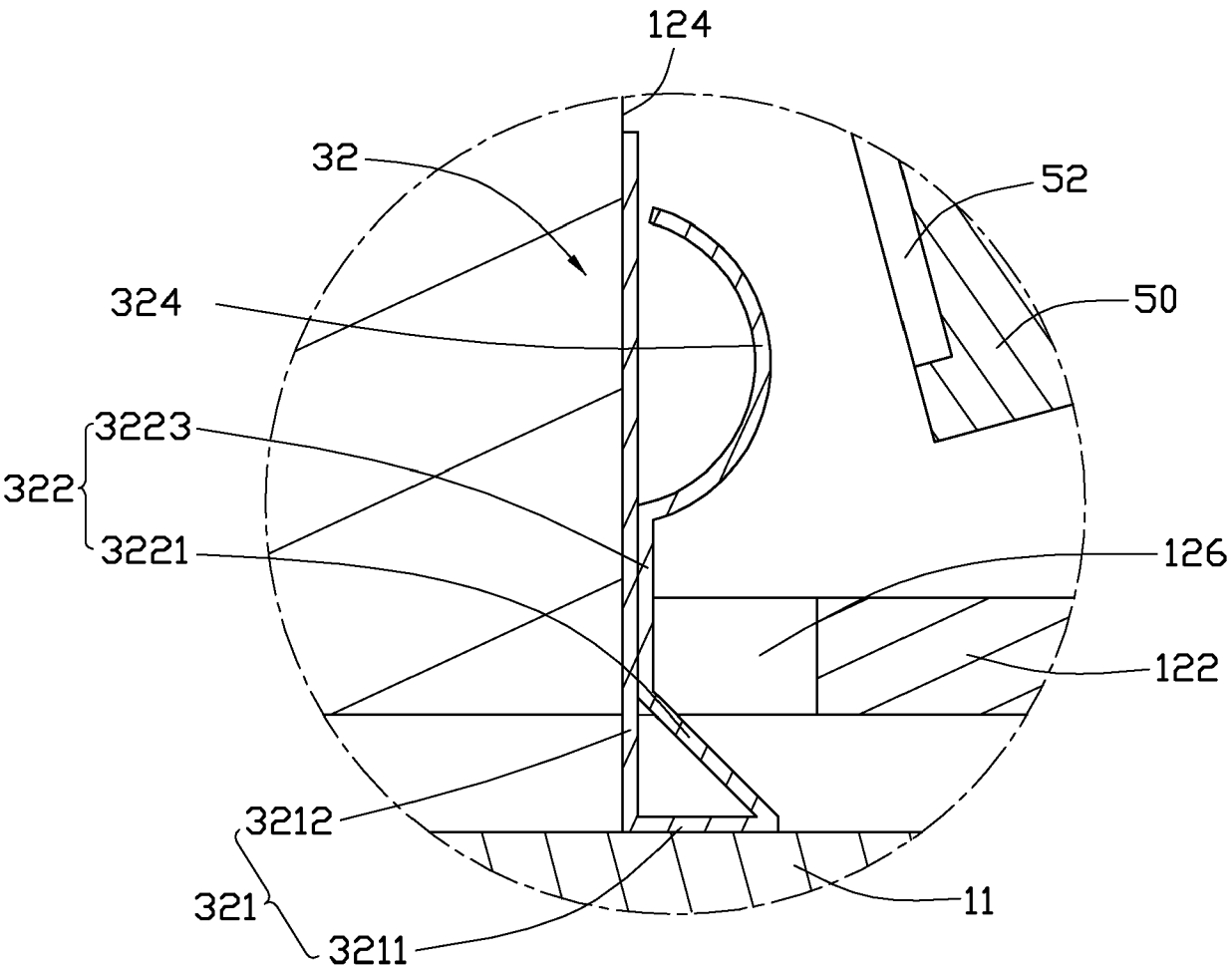
FIG. 5 is an enlarged view at V area shown in FIG. 4.

Referring to FIG. 3 to FIG. 5, the battery connecter 30 includes a plurality of terminals 32 made of metal, such as copper, gold and etc. Each of the terminal 32 is substantially R-shaped made by a metal strip and includes a resisting portion 321, a supporting portion 322, and a contacting portion 324.

The resisting portion 321 is L-shaped including a first portion 3211 and a second portion 3212 perpendicularly connecting with the first portion 3211. The first portion 3211 is welded onto the printed circuit board 11. The second portion 3212 is secured on the peripheral wall 124. The supporting portion 322 includes a rib 3221 and a fixing sheet 3223 angled with the rib 3221. The rib 3221 extends from a free end of the first portion 3211 to the second portion 3212. The rib 3221 and the first portion 3211 cooperatively define an acute angle therebetween. The fixing sheet 3223 extends from the rib 3221 and resists the second portion 3212. The fixing sheet 3223 is configured for improving strength of the resisting portion 321. In the exemplary embodiment, the fixing sheet 3223 is fixed on the second portion 3212. The contacting portion 324 extends from the fixing sheet 3223 and is bent into arc shape. In the exemplary embodiment, a free end of the contacting portion 324 is spaced from the second portion 3212. When the battery 50 resists the contacting portion 324, the contacting portion 324 can move towards the second portion 3212 and contacts with the second portion 3212.

The battery 50 includes a plurality of contacts 52. The contacts 52 electronically connect to the contacting portion 324 for providing power to the portable electronic device 100.

In assembly, the battery 50 is placed into the receiving chamber 12. The contacts 52 resist the battery connecter 30 and connect to the contacting portion 324. The contacting portion 324 is moved toward the second portion 3212 and contacts with the second portion 3212. Thus, the battery 50 provides power to the portable electronic device 100 by the battery connecter 30.

It is to be understood that, the battery connecter 30 also can be used in laptops, personal digital assistants (PDAs) and etc.

The battery connecter 30 can be strengthened effectively by using the supporting portion 322, thus prolonging life of the battery connecter 30.

It is to be understood, however, that even through numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A battery connecter, comprising:

a plurality of terminals, each of the terminals being generally R-shaped and comprising:

a resisting portion being L-shaped and including a first portion and a second portion perpendicularly connecting with the first portion;

a supporting portion including a rib and a fixing sheet, the rib extending from the first portion, and the rib and the first portion cooperatively defining an acute angle therebetween, the fixing sheet angled connecting with the rib and constantly resisting the second portion; and a contacting portion arching relative to the second portion and extending from the fixing sheet of supporting portion.

2. The battery connecter as claimed in claim 1, wherein a free end of the contacting portion is spaced from the second portion.

3. A portable electronic device, comprising:

a main body including a receiving chamber defined by a peripheral wall, and a printed circuit board positioned under the bottom of the chamber and perpendicularly with the peripheral wall;

a plurality of terminals positioned in the main body and partially received in the receiving chamber, each terminal comprising:

a resisting portion being L-shaped and including a first portion welded onto the printed circuit board and a second portion connecting with the first portion and securely attaching on the peripheral wall of the receiving chamber;

a supporting portion including a rib and a fixing sheet, the rib extending from the first portion, and the rib and the first portion cooperatively defining an acute angle therebetween, the fixing sheet angled connecting with the rib and constantly resisting the second portion; and a contacting portion arching relative to the second portion and extending from the fixing sheet of supporting portion.

4. The portable electronic device as claimed in claim 3, wherein a free end of the contacting portion is spaced from the second portion.

5. The portable electronic device as claimed in claim 4, further comprises a battery resisting the contacting portion, the contacting portion is moved towards of the second portion and contacts with the second portion.

* * * * *